US005453772A

United States Patent [19]

Aono et al.

[11] Patent Number: 5,453,772

[45] Date of Patent: Sep. 26, 1995

[54] LIQUID CONTAINER WITH BLADDER-LIKE MEMBER AND LIQUID PATH ALONG AN INTERIOR CONTAINER WALL

[75] Inventors: Kenji Aono, Kawasaki; Yoshifumi Hattori, Yamato; Masashi Kitani; Etsurou Suzuki, both of Yokohama; Hideo Saikawa, Kawasaki; Masami Kojima; Kenji Kawano, both of Tokyo; Koichi Tanno, Kawasaki, all of Japan

[73] Assignee: Canon Kabushiki Kaisha, Tokyo, Japan

[21] Appl. No.: 400,383

[22] Filed: Mar. 3, 1995

Related U.S. Application Data

[63] Continuation of Ser. No. 900,412, Jun. 18, 1992, abandoned.

[30] Foreign Application Priority Data

Jun. 19, 1991 [JP] Japan ..... 3-147391

[51] Int. Cl.[6] ..... B41J 2/175

[52] U.S. Cl. ..... 347/87

[58] Field of Search ..... 347/86, 87; 222/185

[56] References Cited

U.S. PATENT DOCUMENTS

| | | | |
|---|---|---|---|
| 3,708,798 | 1/1973 | Hildenbrand et al. | 347/86 |
| 4,313,124 | 1/1982 | Hara | 347/57 |
| 4,345,262 | 8/1982 | Shirato et al. | 347/10 |
| 4,434,430 | 2/1984 | Koto | 347/20 |
| 4,459,600 | 7/1984 | Sato et al. | 347/47 |
| 4,463,359 | 7/1984 | Ayata et al. | 347/56 |
| 4,475,116 | 10/1984 | Sicking et al. | 347/86 |
| 4,558,333 | 12/1985 | Sugitani et al. | 347/65 |
| 4,723,129 | 2/1988 | Endo et al. | 347/56 |
| 4,723,688 | 2/1988 | Munoz | 222/185 |
| 4,740,796 | 4/1988 | Endo et al. | 347/56 |
| 5,237,342 | 8/1993 | Saikawa et al. | 347/87 |
| 5,270,739 | 12/1993 | Kitani et al. | 347/86 |

FOREIGN PATENT DOCUMENTS

| | | |
|---|---|---|
| 0419192 | 3/1991 | European Pat. Off. . |
| 0496620 | 7/1992 | European Pat. Off. . |
| 2543991 | 4/1977 | Germany . |
| 59-123670 | 7/1984 | Japan . |
| 59-138461 | 8/1984 | Japan . |
| 59-204566 | 11/1984 | Japan . |
| 60-082353 | 5/1985 | Japan . |

OTHER PUBLICATIONS

"Replaceable Ink Cartridge for Ink Jet Print Head," IBM Technical Disclosure Bulletin, vol. 34, No. 1, Jun. 1991.

*Primary Examiner*—Benjamin R. Fuller
*Assistant Examiner*—John E. Barlow, Jr.
*Attorney, Agent, or Firm*—Fitzpatrick, Cella, Harper & Scinto

[57] ABSTRACT

An ink tank for storing ink to be supplied to a recording unit comprises a bag-like member arranged in an inner space of the ink tank and communicating with the atmosphere, which bag-like member has a volume variable from substantially zero to a volume substantially equal to that of the inner space of the ink tank. Ink is stored in a space defined between the ink tank and the bag-like member and a liquid path is formed in an inner wall surface of the ink tank.

14 Claims, 3 Drawing Sheets

LIQUID CONTAINER WITH BLADDER-LIKE MEMBER AND LIQUID PATH ALONG AN INTERIOR CONTAINER WALL

This application is a continuation of application Ser. No 07/900,412 filed Jun. 18, 1992, now abandoned.

BACKGROUND OF THE INVENTION

1. Field of the Invention

The present invention relates generally to ink jet recording, and more particularly, to an ink tank for storing ink to be supplied to a recording means which is adapted to discharge the ink for recording; an ink jet head cartridge which has such ink tank and recording means integrated with each other; and an ink jet recording apparatus equipped with the ink jet head cartridge.

2. Related Background Art

An ink jet recording apparatus adapted to discharge ink from discharging orifices thereof for performing desired recording has mounted therein an ink tank for storing ink which is supplied to a recording head for discharging the ink. Such ink tanks may be mainly classified into a type which stores liquid ink as it is in an ink tank housing and a type which stores liquid ink absorbed in an absorptive material in an ink tank housing. In particular, the former type is capable of storing a large amount of liquid ink and is widely utilized because of its relatively high utilizing efficiency of ink. There have been proposed two styles for the ink tank of the type which stores liquid ink as it is. More specifically, one is an ink tank provided with an ink sack for storing ink, and the other one is an ink tank which directly stores ink in space defined between a housing and an air bag, the inside of which communicates with the atmosphere, as described, for example, in Japanese Laid-open Patent Application No. 60-82353. The latter is advantageous over the former in that an inner wall portion of the ink storing housing can be effectively utilized and therefore an ink storing ratio is higher with the outer size being equal.

With the latter style, however, it is difficult to favorably introduce air into the air bag to uniformly inflate same. In other words, an increase of volume of the air bag may lack uniformity depending on an initial condition of the air bag.

Also, since a low rigidity material is used for the air bag to allow a change in volume, if an external shock is applied to the air bag for some reason, the air bag violently swings, which possibly results in inconsistency of ink supply.

The above-mentioned inconsistent increase of volume or swinging movement of ink, if it arises, may cause difficulties in maintaining a favorable ink supply condition from the ink tank to an ink introducing pathway. For example, if an air bag portion positioned on the ink supply side is inflated earlier due to an inconsistent change in volume of the air bag, ink present in the opposite area cannot be favorably introduced to a supply port, thereby possibly causing degradation of the ink utilization efficiency.

SUMMARY OF THE INVENTION

The present invention has been proposed to solve the above-mentioned problems, and its object is to provide an improved ink tank of a type having an air bag in its housing which is capable of favorably supplying a recording head with ink which is accumulated in space between the inner wall of the ink tank and the air bag so as to substantially use up all ink; an ink jet head cartridge having such an ink tank; and an ink jet recording apparatus in which the cartridge can be mounted.

To achieve the above object, the present invention provides an ink tank for storing ink to be supplied to a recording means, which comprises a bag-like member arranged in inner space of the ink tank and communicating with the atmosphere, which has a volume variable from a substantially zero state to a volume substantially equal to that of the inner space of the ink tank; ink stored in a space region defined between the ink tank and the bag-like member; and a rough portion formed in an inner wall surface of the ink tank.

The present invention also provides an ink jet head cartridge integrally having recording means for discharging ink to perform predetermined recording and an ink tank for storing ink to be supplied to the recording means, which comprises a bag-like member arranged in inner space of the ink tank and communicating with the atmosphere, which has a volume variable from a substantially zero state to a volume substantially equal to that of the inner space of the ink tank; ink stored in a space region defined between the ink tank and the bag-like member; and a rough portion formed in an inner wall surface of the ink tank.

The present invention further provides an ink jet recording apparatus having a mounting member for removably mounting thereon an ink jet head cartridge which integrally comprises recording means for discharging ink to perform predetermined recording and an ink tank for storing ink to be supplied to the recording means, which comprises a bag-like member arranged in inner space of the ink tank and communicating with the atmosphere, which has a volume variable from a substantially zero state to a volume substantially equal to that of the inner space of the ink tank; ink stored in a space region defined between the ink tank and the bag-like member; and a rough portion formed in an inner wall surface of the ink tank.

Since the rough portion formed in the inner wall surface of the ink tank effectively functions as an ink introducing pathway, when the volume of the bag-like member in the ink tank is expending as the ink is being consumed, substantially closed space is not formed between the inner wall surface of the ink tank and the bag-like member, thereby allowing ink to favorably move to an ink supply port.

DETAILED DESCRIPTION OF THE PREFERRED EMBODIMENTS

The present invention will hereinafter be described in detail with reference to the accompanying drawings.

(First Embodiment)

Figure 1:
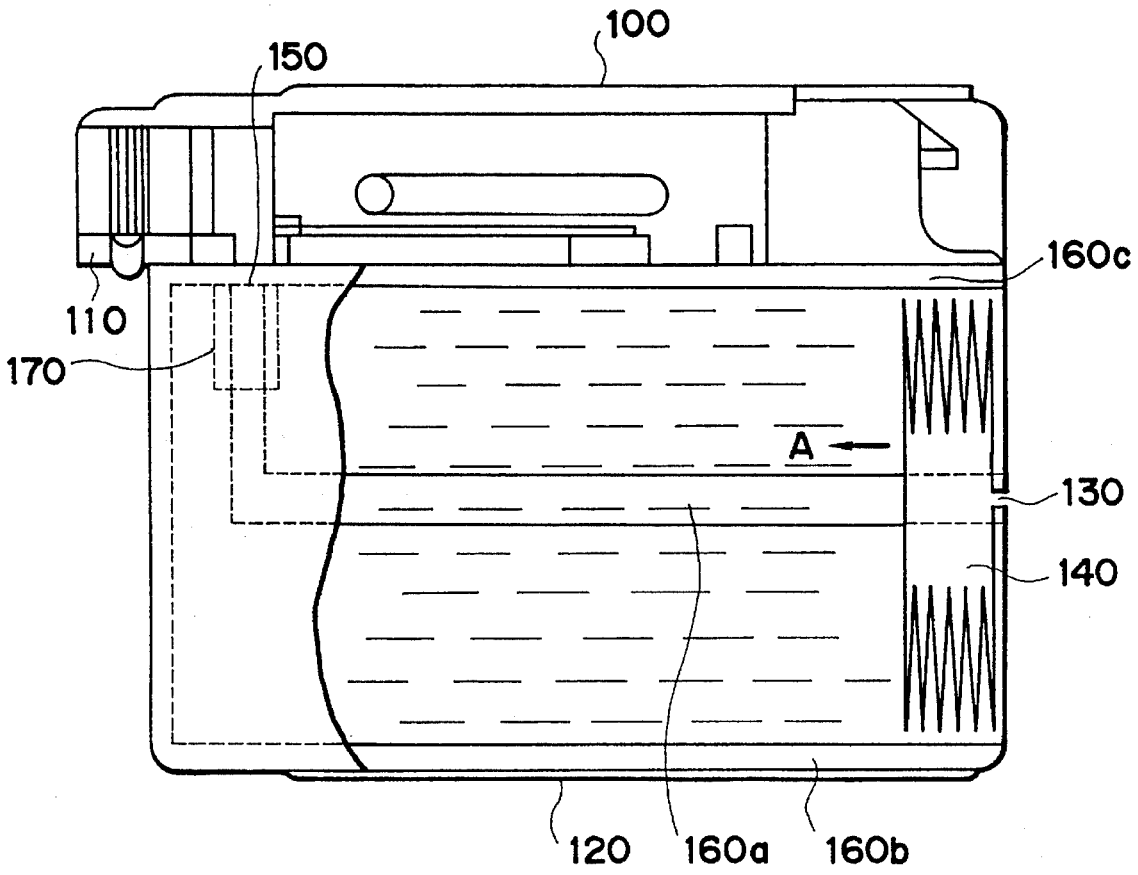
FIG. 1 is a partially cut-away front view schematically showing an embodiment of an ink jet head cartridge according to the present invention.

FIG. 1 schematically shows an ink jet head cartridge integrally having a recording head according to an embodiment of the present invention and an ink tank for storing ink which is supplied to the recording head.

In FIG. 1, an ink jet head cartridge generally designated by 100 comprises a recording head 110 and an ink tank 120 for storing ink which is supplied to the recording head 110. The ink tank 120, integrated with the recording head 110, has a housing defining the outer profile of the cartridge and a bag-like member 140 communicating with the atmosphere through an atmosphere communicating port 130 and having its volume increased in accordance with a consumed amount of ink stored in the ink tank 120. Ink supplied to the recording head 110 is stored in space defined between this housing and the bag-like member 140.

In this ink jet cartridge 100, the ink stored in the ink tank 120 is consumed as recording is performed. In accordance with a consumed amount, air enters through the air communicating port 130 to expand the volume of the bag-like member 140 connected to the atmosphere communicating port 130 in the direction indicated by A so as not to cause the pressure to fluctuate in the ink tank 120. This bag-like member 140 is capable of expanding all over the ink tank 120 when the ink stored therein is used up. Basically in this event, the entire bag-like member 140 uniformly expands. However, since the cartridge of the present embodiment is mounted in a recording apparatus which performs recording by scanning the cartridge on a recording region, a uniform expansion of the bag-like member 140 may be prevented by the scanning of the cartridge, which may lead to hindering a favorable introduction of the ink stored in the ink tank 120 to an ink supply port 150 of the recording head 110. The present embodiment solves this inconvenience by means of four ink introducing pathways represented by 160*a*, 160*b*, 160*c* and 160*d* (160*d* is not shown) which are formed in the inner wall surface of the ink tank 120. The present embodiment shows an example where the ink introducing pathways 160*a*–160*d*, each having predetermined depth and width, are formed as grooves in the inner wall surface of the housing of the ink tank 120. By forming the grooves as ink introducing pathways in the inner wall surface, even if the bag-like member 140 fails to expand uniformly, space between the bag-like member 140 and the inner wall surface of the housing will not be closed, so that ink is favorably introduced to the ink supply port 150 through the ink introducing pathways 160*a*–160*d*. The ink stored in the ink tank 120, therefore, is all used effectively for recording, thereby improving the ink utilizing efficiency.

It should be noted that the number and the form of the ink introducing pathways 160 formed in the inner wall surface of the ink tank 120 are not limited to those as mentioned above. Any structure may be taken as long as it can favorably introduce to the ink supply port 150 ink which is likely to accumulate in the space defined between the inner wall surface of the ink tank 120 and the bag-like member 140. For example, the inner wall surface of the ink tank 120 may be provided with ribs to form gaps between the inner wall surface of the ink tank and the bag-like member 140. Incidentally in FIG. 1, a means for developing a predetermined necessary pressure on the ink tank side is arranged around the ink supply port 150 for maintaining ink meniscus at a discharging orifice of the recording head 110. As the negative pressure developing means 170, an absorptive material is employed in the present embodiment.

(Second Embodiment)

Figure 2:
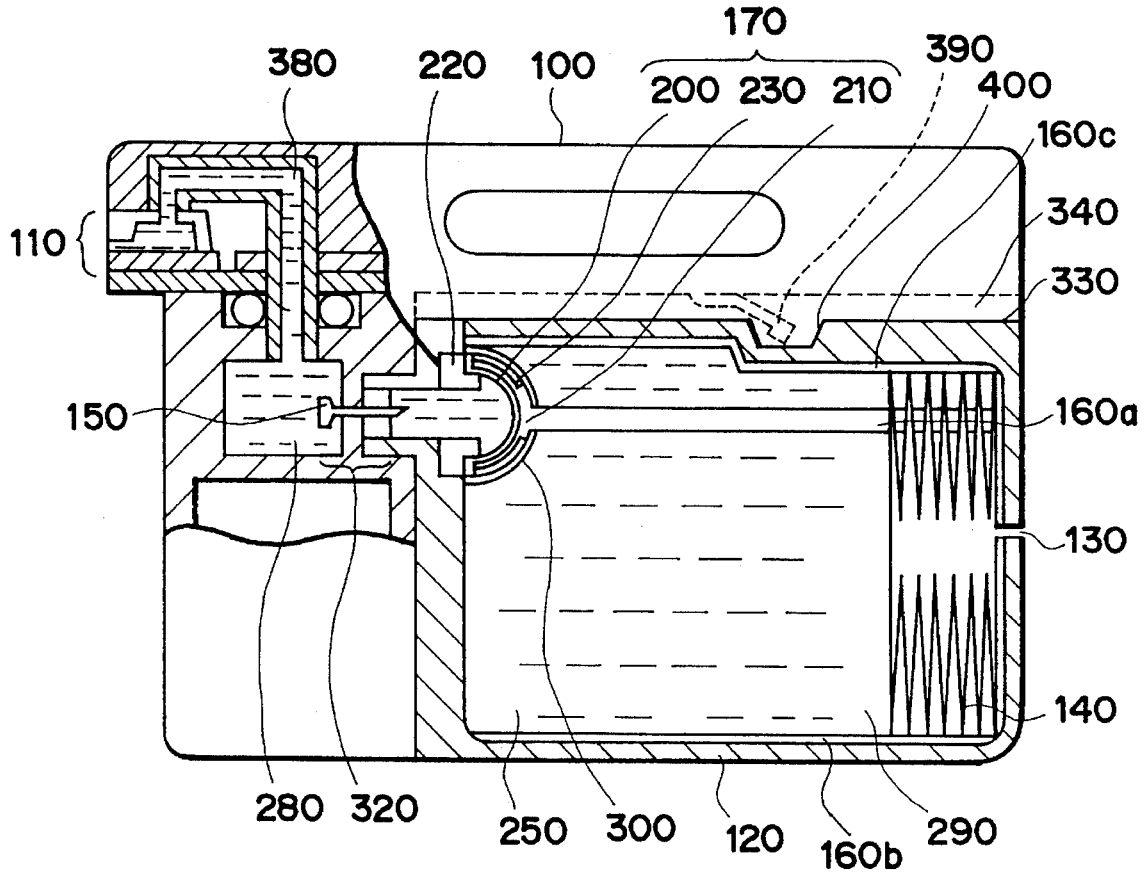
FIG. 2 is a partially cut-away front view schematically showing another embodiment of an ink jet head cartridge according to the present invention.

FIG. 2 shows a second embodiment of the present invention. The second embodiment shows an ink jet head cartridge of a small-capacity type having an ink tank with a capacity of approximately 10 cc. The ink tank is made removable from a recording head. The ink jet head cartridge shown in FIG. 2 comprises the recording head 110; a means 170 for adjusting pressures in the recording head and the ink tank, formed of a slit bladder 200, a slit 210 and a collapsing direction restricting member 230; a mounting rest 220; an ink tank for exchange 250; a first ink container 280 arranged on the recording head side having an extremely small capacity; a second ink container 290 on the ink tank side; a swing preventing wall 300; a guide 330 on the ink tank side; a guide 340 on the recording head side; an ink flow path 380; and a connector 320 for connecting the recording head 110 with the ink tank 120. The ink tank 120, when mounted on the recording head 110, has a recess 400 thereof engaged with a stopper 390 on the recording head side so as to maintain a mounted state. The ink tank 120 is removed by releasing the stopper 390 from the recess 400.

The second ink container 290 is provided therein with a bag-like portion and ink introducing pathways, similarly to the first embodiment, as well as the split bladder 200 arranged near an ink supply port at a junction of the ink tank with the recording head, as shown in FIG. 2. The inner wall surface of the ink tank 120 is formed with four ink introducing pathways designated 160*a*, 160*b*, 160*c* and 160*d* (160*d* is not shown). The present embodiment shows an example where the ink introducing pathways 160*a*–160*d* are formed as grooves in the inner wall surface of a housing of the ink tank 120. By forming the grooves 160*a*–160*d* in the inner wall surface as the ink introducing pathways, even if the bag-like member 140 fails to expand uniformly, space between the bag-like member 140 and the inner wall surface of the housing will not be closed, so that ink is favorably introduced to the ink supply port 150 through the ink introducing pathways 160. The ink stored in the ink tank 110, therefore, is all used effectively for recording, thereby improving the ink utilizing efficiency.

It should be noted that the ink introducing pathways 160 formed in the inner wall surface of the ink tank are not limited to the number and the groove shape as mentioned above. Any structure may be taken as long as it can favorably introduce to the ink supply port 150 ink which is likely to accumulate in the space defined between the inner wall surface of the ink tank and the bag-like member 140. For example, the inner wall surface of the ink tank may be provided with ribs to form gaps between the inner wall surface of the ink tank 120 and the bag-like member 140, as mentioned above in connection with the first embodiment. Incidentally in FIG. 2, the slit bladder 170 or a means for developing a predetermined necessary pressure on the ink tank side is arranged near the ink supply port 150 for maintaining ink meniscus at a discharging orifice of the recording head 110.

This slit bladder is made of an elastic material having a hardness approximately ranging from 15° to 70° (according to the rubber hardness indication shown in JISA. The hardness is hereinafter represented in the same manner), preferably an elastic material having a hardness from 25° to 50°. Since the slit bladder contacts ink in the ink tank, the material usable therefor must not include components which cause a change in physical properties (surface tension, viscosity and so on) of the ink or components which are susceptible to solve in the ink. It is also required, simultaneously, that the ink never induces a change in physical properties of these materials. Specific materials preferably usable for the slit bladder may be those which satisfy the above-mentioned rubber hardness and conditions, for example, silicone rubber, SBR-BR-IR-EPM-EPDM-butyl rubber, chloroprene rubber, urethane rubber, fluorine rubber, nitryl rubber, acrylic rubber, rubber polysulfide, ethylene rubber, phlorosilicon rubber, SEP rubber (silicone denaturated ethylene propylene rubber), and so on.

The mounting rest 220 for fixing the slit bladder 200 thereon has a mounting base formed on conformity with the outer peripheral shape of the bladder base, specifically in an elliptic shape in the present embodiment. The slit 210 of the slit bladder 200 is mounted so as to be perpendicular to the major axis of the ellipse of the mounting rest 220. As a result, a difference of tension between the major axis direction and the minor axis direction of the ellipse of the mounting rest 220, on which the slit bladder 200 is mounted, is generated on a side wall of the slit bladder 200, which causes the slit bladder 200 to be collapsed, whereby the slit can be smoothly opened.

This angle, however, may be more or less deviated as long as it is within a range from 0° to 55°. The slit bladder 200 is arranged in a region where the ink tank is removed from the recording head, whereby a change in pressure possibly occurring when mounting or removing the ink tank onto or from the recording head is damped by the slit bladder 200, so that ink in the ink tank is free from such influence.

Incidentally, a printer employing a small capacity type ink jet head cartridge is in many cases designed so as to be installed vertically as well as horizontally. The ink jet head cartridge is therefore required to be usable in both the vertically and horizontally installed states. In the present embodiment, thus, a negative pressure of the slit bladder was designed in consideration of an ink head pressure in the ink tank such that the ink jet head cartridge is free from leakage of ink and provides a satisfactory printing quality irrespective of vertical or horizontal installation. Also, by arranging the slit bladder at a location where a remaining amount of ink in the ink tank is reduced to the utmost, the ink tank is made usable in either vertical or horizontal installations.

When an ink tank capacity is below 10 cc, an ink tank usable in the vertically or horizontally installed state can be designed, in the same manner as mentioned above, by designing a negative pressure of a slit bladder in relation to an ink head pressure in the ink tank acting on a nozzle of a recording head so as to prevent ink from leaking, when the ink jet head cartridge is vertically installed, within a printing enable range of the recording head, and also by arranging the slit bladder at a location where a remaining amount of ink in the ink tank is reduced to the utmost. On the contrary, an ink tank with a capacity of 10 cc or more can be realized to some extent by appropriately determining the shape of the ink tank so as to prevent at ink head pressure in the ink tank from excessively developing, in addition to suitably designing a negative pressure and an arranged location of a slit bladder. However, unless a small capacity ink tank, because of its small capacity, is provided with a small size slit bladder, ink will remain below a slit outside the slit bladder in the ink tank, which results in increasing a proportion of unusable ink. It is therefore necessary to determine the curvature of the slit bladder in a shape which can make the size thereof as small as possible and then design a negative pressure so as to enter within the foregoing values by suitably selecting an elasticity ratio and a thickness.

Figure 3:
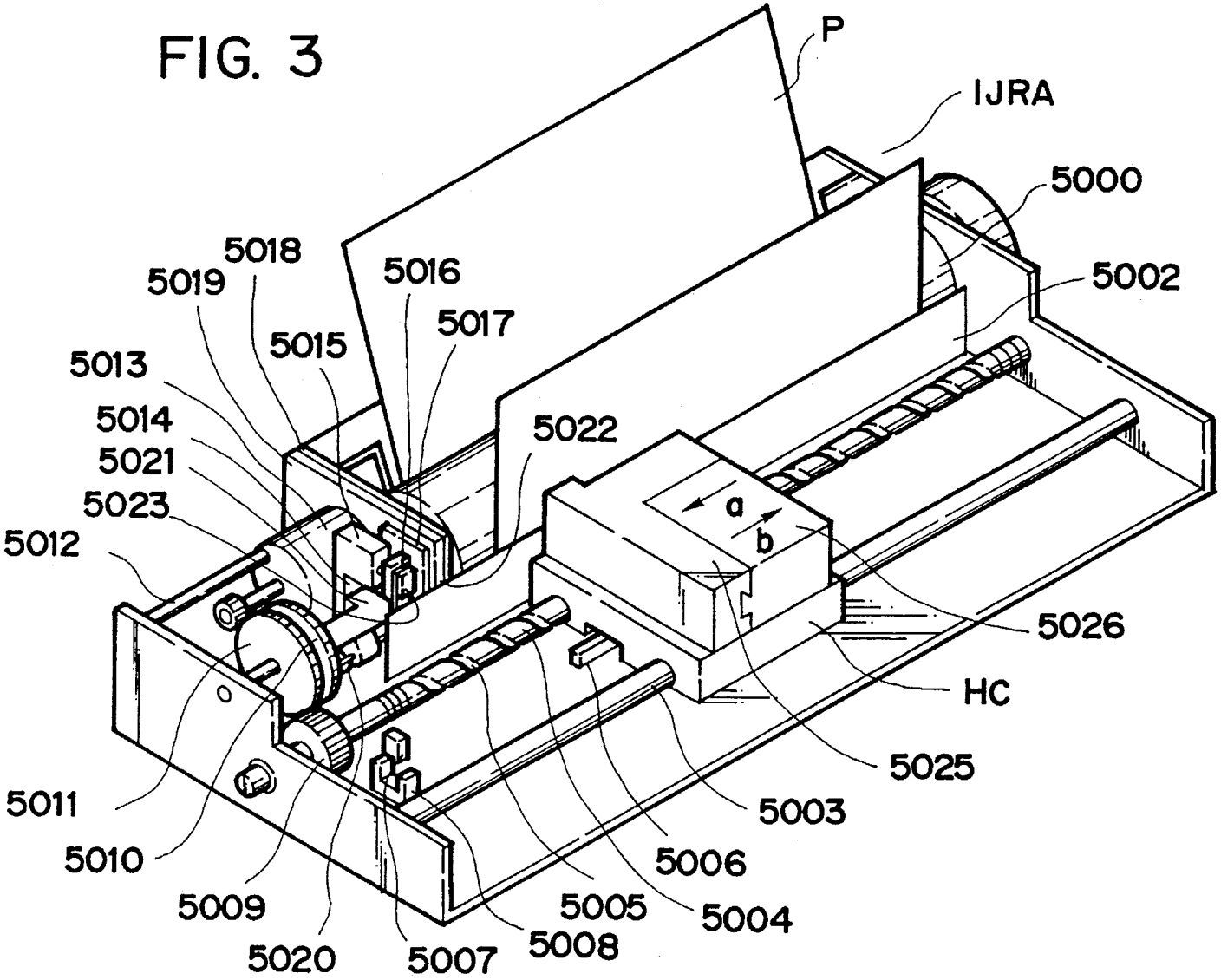
FIG. 3 is a perspective view schematically showing an ink jet recording apparatus according to the present invention.

FIG. 3 is a perspective view showing an ink jet recording apparatus IJRA to which the ink jet head cartridge of the present invention is applied. A carriage HC has a pin (not shown) which is engaged with a spiral groove 5005 formed in the peripheral surface of a lead screw 5004 which rotates in association with forward or backward rotation of a driving motor 5013 through driving force transmitting gears 5011 and 5009. The carriage HC is thus reciprocally moved in the direction indicated by the arrow a or b. On the carriage HC there are mounted a recording head 5025 and an ink tank 5026. The ink jet recording apparatus IJRA further comprises a sheet fixing plate 5002 which urges a sheet against a platen 5000 toward the carriage moving direction; photo-couplers 5007 and 5008 which serve as a home position detecting means for confirming the existence of a carriage lever 5006 in a range defined by the photo-couplers 5007, 5008 to switch the rotating direction of the motor 5013; member 5016 for supporting a cap member 5022 for capping the front face of the recording head; an absorbing means 5015 for absorbing in the cap member 5022 to absorptively recover the recording head through an opening 5023 formed in the cap member 5022; a cleaning blade 5017; a member 5019 for making the cleaning blade movable in the front and back directions; a body supporting plate 5018 for supporting these members; and a lever 5012 for starting absorption for the absorptive recovery. The lever 5012 moves in association with a movement of a cam 5020 engaged with the carriage HC, where a driving force from the driving motor 5013 is controlled by a known transmitting means such as a clutch.

The ink jet recording apparatus of the embodiment is constructed in a manner that capping, cleaning and absorptive recovery are performed as desired at respective corresponding positions thereof by the action of the lead screw 5005 when the carriage HC is positioned in the home position area. If a desired operation is performed at a known timing, any operation is applicable to the present embodiment.

Among a variety of ink jet recording methods, the present invention produces excellent effects particularly in a recording head and a recording apparatus of a type which is provided with a means for generating thermal energy (for example, an electro-thermal transducer, a laser beam or the like) utilized as energy for discharging ink, and causes a change in an ink state by the thus generated thermal energy.

The typical structure and principle of this type of recording apparatus preferably employs the basic principles disclosed, for example, in U.S. Pat. Nos. 4,723,129 and 4,740,796. This system is applicable to either of so-called on-demand type and continuous type. Particularly, this system is effective in the on-demand type since the on-demand type is adapted to apply at least one driving signal for causing a rapid temperature rise corresponding to recording information and exceeding the nucleate boiling to an electro-thermal transducer arranged corresponding to a sheet and a liquid pathway in which liquid (ink) is held so as to generate thermal energy in the electric-thermal transducer, cause film boiling to occur on a heat acting face of a recording heat, and consequently form bubbles in the liquid (ink) which correspond to the driving signal one by one. The liquid (ink) is discharged from a discharging orifice by the growth and contraction of bubble to form at least one droplet. It is preferable that a pulse signal is used as the driving signal because the growth and contraction of bubble are immediately and properly controlled thereby, so that an ink discharging mechanism, particularly excellent in a response characteristic, is achieved. As this pulse-shaped driving signal, those described in the specifications of U.S. Pat. Nos. 4,463,359 and 4,345,262 are suitable. Further, if conditions described in the specification of U.S. Pat. No. 4,313,124 concerning a temperature rising ratio on the heat acting face are employed, further excellent recording can be achieved.

It should be noted that the present invention includes the structure of the recording head that employs inventions described in the specifications of U.S. Pat. Nos. 4,558,333 and 4,459,600 which disclose a structure in which a heat acting portion is arranged in a bent region, in addition to a combined structure (a straight flow pathway or a perpendicular flow pathway) formed of a discharging orifice, a liquid pathway and an electro-thermal transducer as disclosed in the above-mentioned respective specifications.

Additionally, the recording head may be constructed on the basis of Japanese Laid-open Patent Application No. 59-123670 which discloses a structure where common slits serve as discharging portions for a plurality of electrothermal transducers and Japanese Laid-open Patent Application No. 59-138461 which discloses a structure where an opening for absorbing pressure wave of thermal energy is arranged corresponding to a discharging portion.

A recording head of a full line type having a length corresponding to the width of the widest recording medium on which a recording apparatus can record may be constituted by either an assembly of a plurality of recording heads to extend over the length or a single integrated recording head.

The present invention is also effective when using a recording head of a tip exchangeable type which is mounted in a recording apparatus to enable an electric connection with the printing apparatus and supply of ink from the printing apparatus.

Also, addition of a recovering means for a recording head, a preparatory supporting means and so on, provided as constituents of the recording apparatus of the present invention, is preferable since the effect of the present invention can be stabilized by these means. Specifically, these means may be a capping means; a cleaning means; a pressurizing or compressing means; a preparatory heating means comprising an electric-thermal transducer; and a heating element other than this or a combination of these two, all provided for the recording head. A preparatory discharging means for performing other discharging than that for recording is also effective for performing stable recording.

Further additionally, the present invention is extremely effective to the recording apparatus that has a recording mode in a main color such as black as well as at least one of a plural color mode using different colors and a full color mode by mixing different colors, by the use of either an integral recording head or a combination of plural recording heads.

According to the present invention as described above, since the rough portion formed in the inner wall surface of the ink tank effectively functions as an ink introducing pathway, when the volume of the bag-like member in the ink tank is expanding as ink is being consumed, substantially closed space is not formed between the inner wall surface of the ink tank and the bag-like member, whereby the ink smoothly moves to the ink supply port. It is therefore possible to provide the ink tank, the ink jet head cartridge and the ink jet recording apparatus which are all excellent in the ink consuming efficiency.

What is claimed is:

1. A liquid storing container for storing liquid to be supplied to liquid discharging means, said container comprising:

a container body for storing liquid;

a liquid supply port on a part of said container body for connecting said container body to the liquid discharging means;

pressure adjusting means on said liquid supply port for generating a negative pressure in the liquid supplied to the liquid discharging means;

an atmosphere-communicating port on a part of said container body;

a bladder-like member on said atmosphere-communicating port for expanding into the interior of said container body in accordance with consumption of the liquid contained in said container body; and a liquid path on an inner wall of said container body, said path extending from a side of said container body where said liquid supply port is located to a side of said container body where said atmosphere-communicating port is located.

2. A liquid storing container according to claim 1, wherein said pressure adjusting means generates negative pressure within a predetermined pressure range.

3. A liquid storing container according to claim 1, wherein said liquid storing container is an integral part of a cartridge which also includes the liquid discharging means and which cartridge is removably mountable on a carriage on an apparatus and is capable of being scanned when mounted on the carriage.

4. A liquid storing container according to claim 3, wherein said pressure adjusting means generates negative pressure within a predetermined pressure range.

5. A liquid storing container according to claim 1, wherein the liquid discharging means is capable of discharging liquid by utilizing thermal energy and an electrothermal transducing element for generating such thermal energy.

6. A liquid storing container according to claim 1, wherein said liquid path comprises a recessed groove in said inner wall, wherein said groove remains unobstructed as said bladder-like member expands.

7. A liquid storing container according to claim 1, wherein said liquid path is defined by a projecting rib on said inner wall for maintaining a space between said inner wall and said bladder-like member as said bladder-like member expands.

8. A liquid storing container according to claim 1, wherein said pressure adjusting means is an absorbing member.

9. A liquid storing container according to claim 1, wherein said pressure adjusting means is an elastic member having a slit which opens in response to a predetermined pressure change.

10. An ink jet recording apparatus comprising:

an ink jet head;

an ink tank for storing ink to be supplied to said ink jet head, said ink tank having:

a container body for storing ink, an ink supply port on a part of said container body for connecting said container body to said ink jet head, pressure adjusting means on said ink supply port for generating a negative pressure in the ink supplied to said ink jet head, an atmosphere-communicating port on a part of said container body, a bladder-like member on said atmosphere-communicating port for expanding into the interior of said container body in accordance with consumption of the ink contained in said container body, and an ink path on an inner wall of said container body, said path extending from a side of said container body where said ink supply port is located to a side of said container body where said atmosphere-communicating port is located; and carriage means for scanning said ink jet head and said ink tank to perform recording.

11. An ink jet recording apparatus according to claim 10, wherein said pressure adjusting means generates negative pressure within a predetermined pressure range.

12. An ink jet recording apparatus according to claim 10, wherein said ink jet head discharges ink by utilizing thermal energy and comprises an electrothermal transducing element for generating such thermal energy.

13. An ink jet recording apparatus according to claim 10, wherein said ink path comprises a recessed groove in said inner wall, wherein said groove remains unobstructed as said bladder-like member expands.

14. An ink jet recording apparatus according to claim 10, wherein said ink path is defined by a projecting rib on said inner wall for maintaining a space between said inner wall and said bladder-like member as said bladder-like member expands.

* * * * *